United States Patent [19]

Goodwin

[11] 4,342,377

[45] Aug. 3, 1982

[54] FORK ATTACHMENT MEANS FOR LIFT TRUCKS

[75] Inventor: Nolen R. Goodwin, Louisville, Miss.

[73] Assignee: Taylor Machine Works, Inc., Louisville, Miss.

[21] Appl. No.: 164,333

[22] Filed: Jun. 30, 1980

[51] Int. Cl.[3] ..... B66B 9/20

[52] U.S. Cl. ..... 187/9 R; 414/785

[58] Field of Search ..... 187/9 R; 414/785, 667, 414/668, 671, 629, 631, 664; 211/123

[56] References Cited

U.S. PATENT DOCUMENTS

| | | | |
|---|---|---|---|
| 2,364,860 | 12/1944 | Lloyd | 211/123 |
| 2,647,641 | 8/1953 | Tritt | 211/123 |
| 2,940,683 | 6/1960 | Tauber et al. | 211/123 |
| 3,356,241 | 12/1967 | Varilek | 414/785 |
| 3,754,673 | 8/1973 | Barda et al. | 414/785 |
| 3,851,779 | 12/1974 | Crawford | 414/785 |
| 3,870,356 | 3/1975 | Meads | 414/671 |
| 4,024,973 | 5/1977 | Siderits et al. | 414/785 |

*Primary Examiner*—Joseph J. Rolla
*Assistant Examiner*—Kenneth Noland
*Attorney, Agent, or Firm*—Walker & McKenzie

[57] ABSTRACT

A fork attachment for a fork lift truck of the type having a vertically movable carriage. The fork assembly includes a pair of frames for being attached side-by-side to the carriage. Each frame includes a pair of side frame members having substantially U-shaped tops. An elongated shaft is adapted to extend between the side frame members of each frame and to rest in the U-shaped tops thereof. A plurality of spaced-apart fork members are slidably attached to each shaft. Outwardly extending pegs on each fork member coact with slots in an elongated bar extending the length of each shaft to control the spacing of the fork members relative to each other.

7 Claims, 16 Drawing Figures

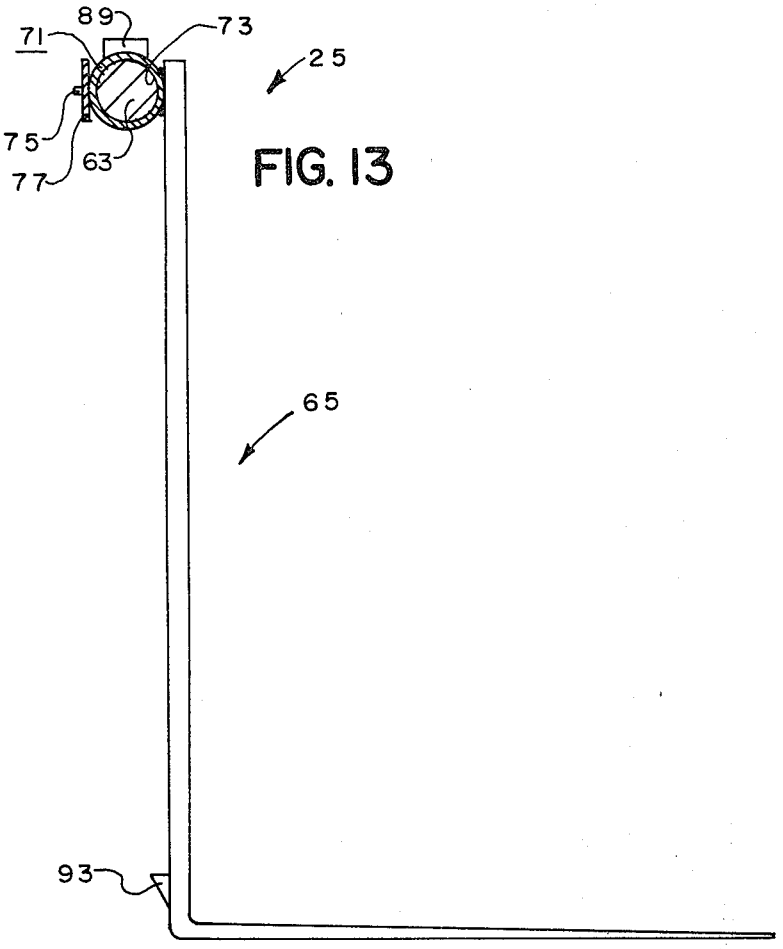
FIG. 13
FIG. 14
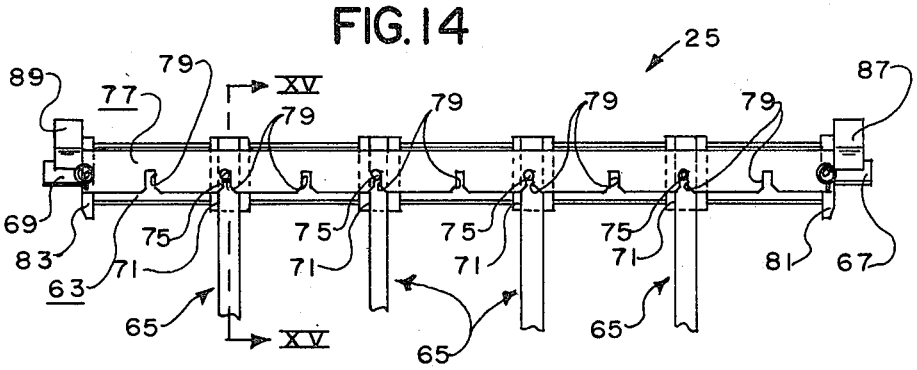

FORK ATTACHMENT MEANS FOR LIFT TRUCKS

BACKGROUND OF THE INVENTION

1. Field of the Invention

The present invention relates in general to fork lift trucks and more specifically to attachment means for attaching various groups of fork assemblies to fork lift trucks.

2. Description of the Prior Art

Various fork lift trucks and fork assemblies therefore have heretofore been developed. See, for example, Cushman, U.S. Pat. No. 2,668,602; Schuster, U.S. Pat. No. 3,027,033; Dearden, U.S. Pat. No. 3,266,599; Varilek, U.S. Pat. No. 3,480,167; Varilek, U.S. Pat. No. 3,356,241; Barda, U.S. Pat. No. 3,754,673; and Crawford, U.S. Pat. No. 3,851,799. None of the above patents disclose or suggest the present invention.

Fork lift trucks are often used to pick up and move varying types of material which require different number and/or spacing and/or type of fork tines. For example, fork lift trucks are used in many "brick yards" to pick up and move both "bricks" and "blocks". Because of the size difference between "bricks" and "blocks" and because of the different way in which "bricks" and "blocks" are stacked, it is typical for such "brick yards" to have at least two lift trucks with one adapted to pick up and move stacks of "bricks" and with the other adapted to pick up and move stacks of "blocks".

SUMMARY OF THE INVENTION

The present invention is directed towards improving upon prior fork lift trucks and the like. The concept of the present invention is to provide a fork lift truck with an attachment means for allowing various groups of fork assemblies with different number and/or spacing and/or type of fork tines to be replaced and/or adjusted in order to lift different types of material and the like. The present invention allows the operator of a fork lift truck to quickly and easily modify the truck from, for example, being specifically adapted to pick up and move a plurality of stacks of "bricks" to being especially adapted to pick up and move a plurality of stacks of "blocks," and vice versa without leaving his seat on the truck.

The attachment means of the present invention includes, in general, a frame means for being attached to the carriage means of a fork lift truck, the frame means including first and second side frame members, each of the side frame members having an upper end and having a notch in the upper end thereof; and fork means for being removably attached to the frame means, the fork means including an elongated shaft member and including a plurality of fork members attached to the shaft member, the shaft member having a first end for being selectively positioned in the notch of the first side frame member and having a second end for being selectively positioned in the notch of the second side frame member whereby the fork means is attached to the frame means.

BRIEF DESCRIPTION OF THE DRAWINGS

FIG. 13 is a sectional view as taken on line XIII—XIII of FIG. 12.

FIG. 14 is a rear elevational view of a portion of one of the fork means of the fork attachment means of the present invention.

DESCRIPTION OF THE PREFERRED EMBODIMENT

Figure 3:
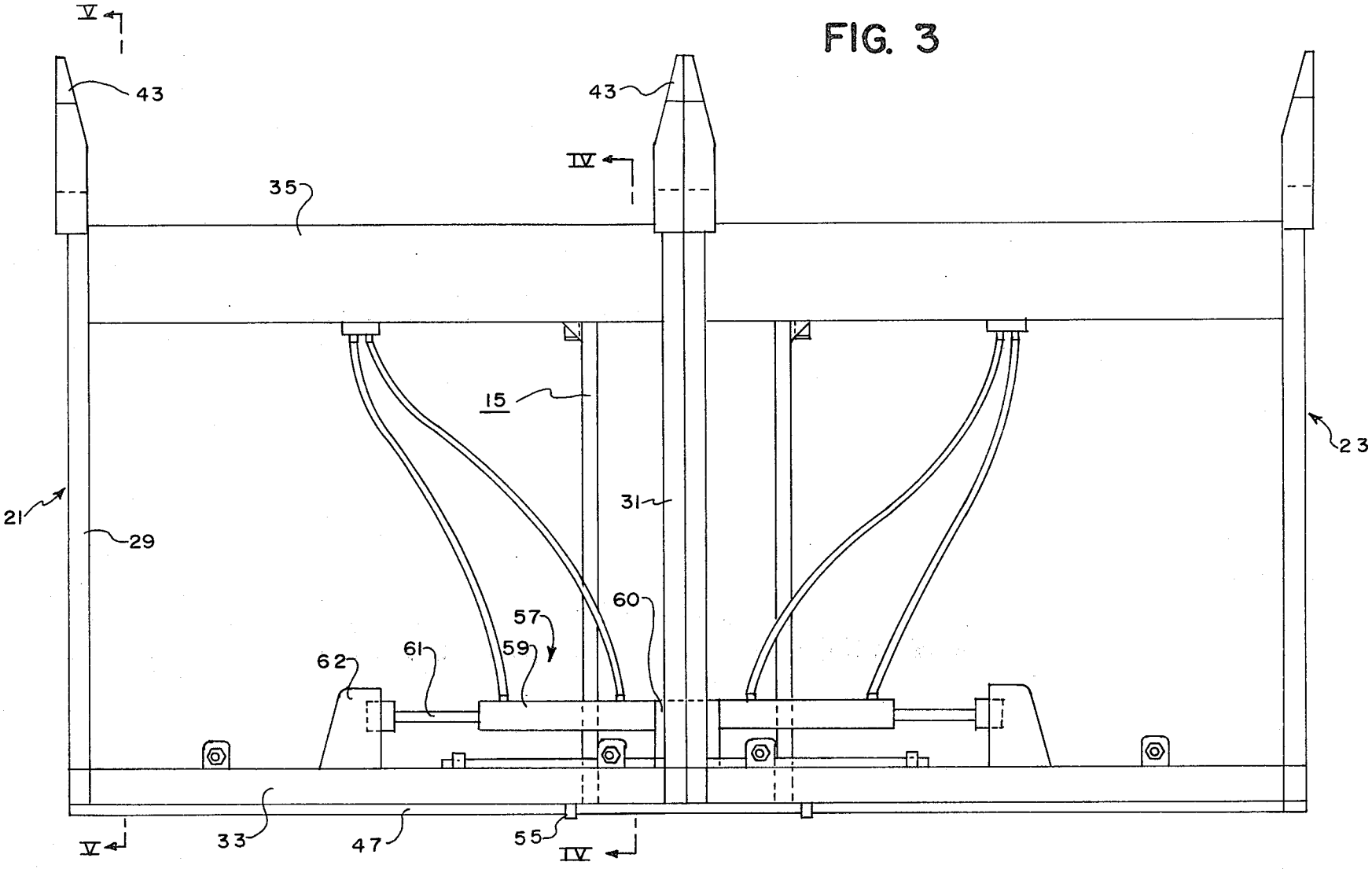
FIG. 3 is a somewhat diagrammatic front elevational view of a portion of two frame means of the fork attachment means of the present invention shown mounted on the carriage of a fork lift truck.
Figure 11:
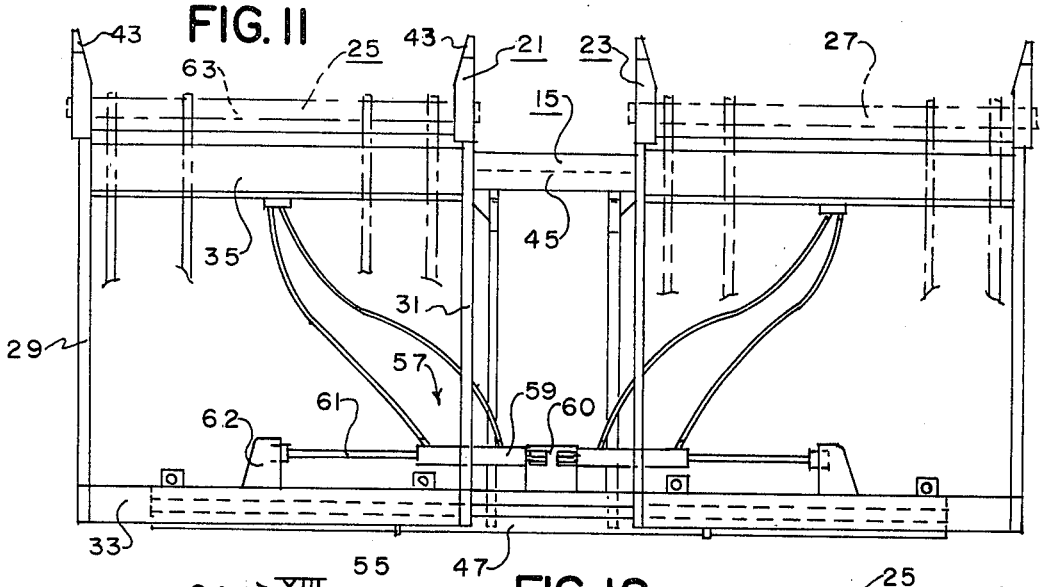
FIG. 11 is a front elevational view similar to FIG. 3 but with the two frame means moved sidewards relative to one another.

The fork attachment means 11 of the present invention is for use on any substantially typical fork lift truck 13 (see, in general, FIG. 1) of the type including a carriage 15 vertically moveable on a mast 17 that can be tilted outwardly from the body of the truck 13 about a pivot 19 or the like in any manner apparent to those skilled in the art. The fork attachment means 11 includes, in general, at least one and preferably two frame means for being attached to the carriage 15 and at least one and preferably two fork means for being removably attached to the frame means. More specifically, the fork assembly 11 preferably includes a first and second frame means 21, 23 for being attached to the carriage 15 (see, in general, FIG. 3) and preferably includes a first and second fork means 25, 27 for being removably attached to the first and second frame means 21, 23 respectfully (see, in general, FIG. 11).

Figure 4:
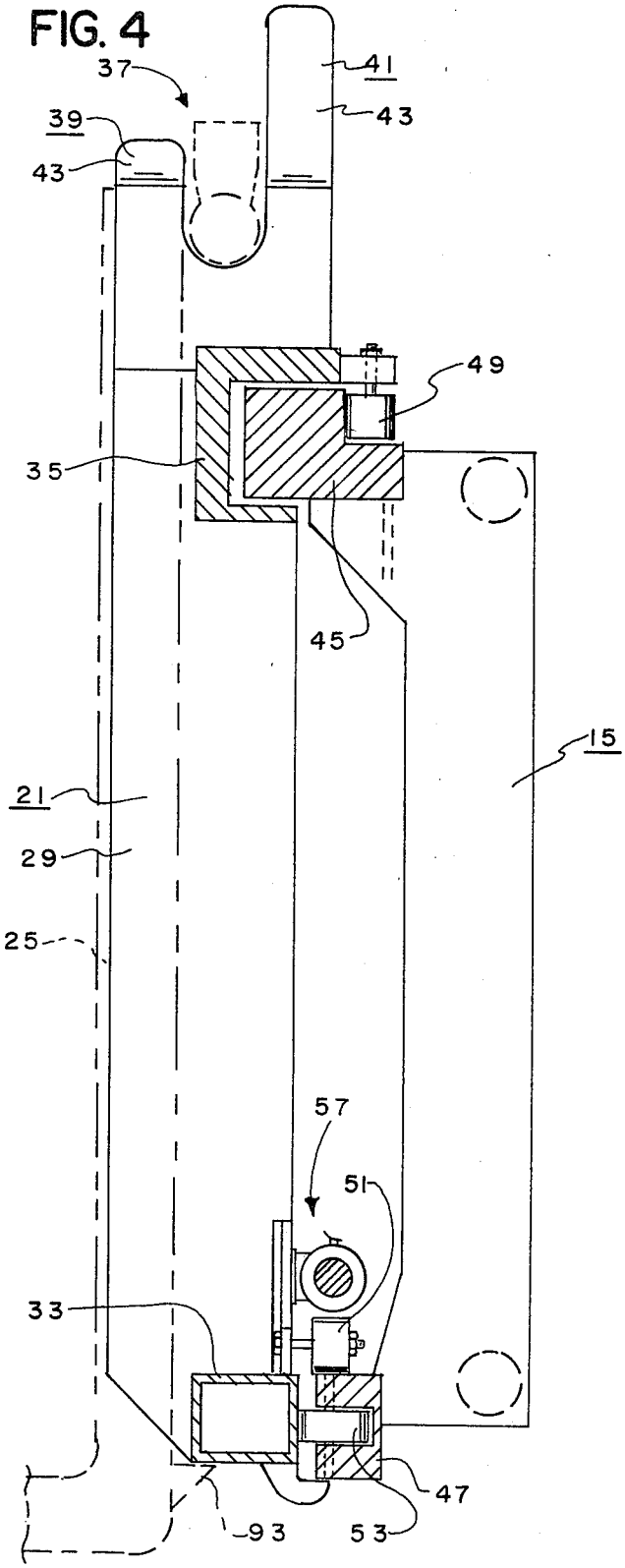
FIG. 4 is a sectional view substantially as taken on line IV—IV of FIG. 3 with portions of one fork means shown in broken lines.
Figure 5:
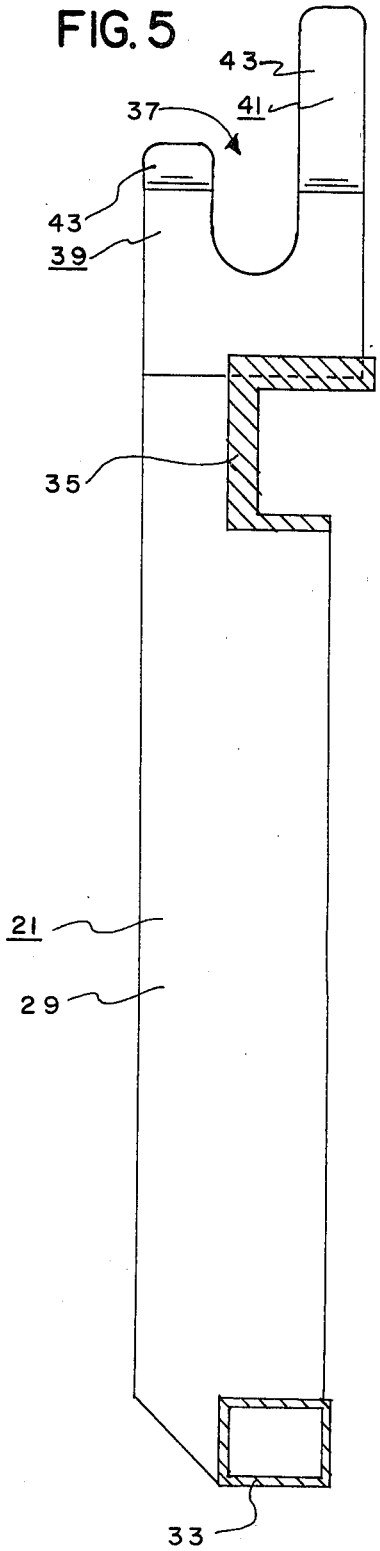
FIG. 5 is a sectional view substantially as taken on line V—V of FIG. 3 with some parts removed for clarity.

The first frame means 21 includes a first side frame member 29 and a second side frame member 31. Preferably, the first frame means 21 includes a lower cross frame member 33 and an upper cross frame member 35 for fixedly joining the first and second side frame members 29, 31 together in a spaced apart relationship (see, in general, FIGS. 3 and 4). The upper end of each side frame member 29, 31 has a notch 37 therein for reasons which will hereinafter become apparent. The notches 37 divide the upper ends of the first and second side frame members 29, 31 into first and second leg portions 39, 41. The second leg portion 41 preferably extends upwardly higher than the first leg portion 39 for reasons which will hereinafter become apparent. At least a portion of the inner side of the upper end of each leg portion 39, 41 is preferably downwardly sloping to form cam surfaces 43 for reasons which will hereinafter become apparent.

Figure 6:
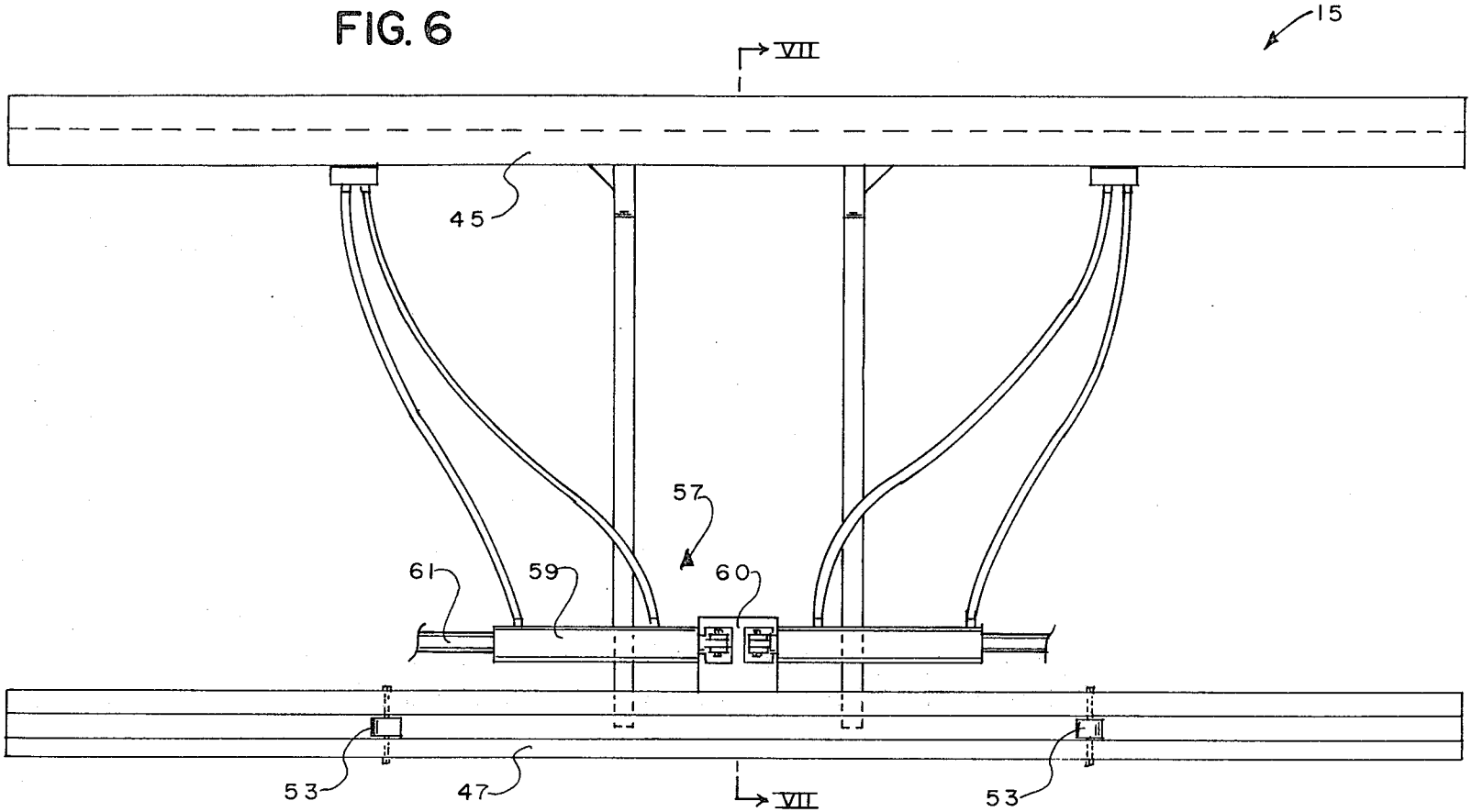
FIG. 6 is similar to FIG. 3 but with portions of the frame means broken away.
Figure 7:
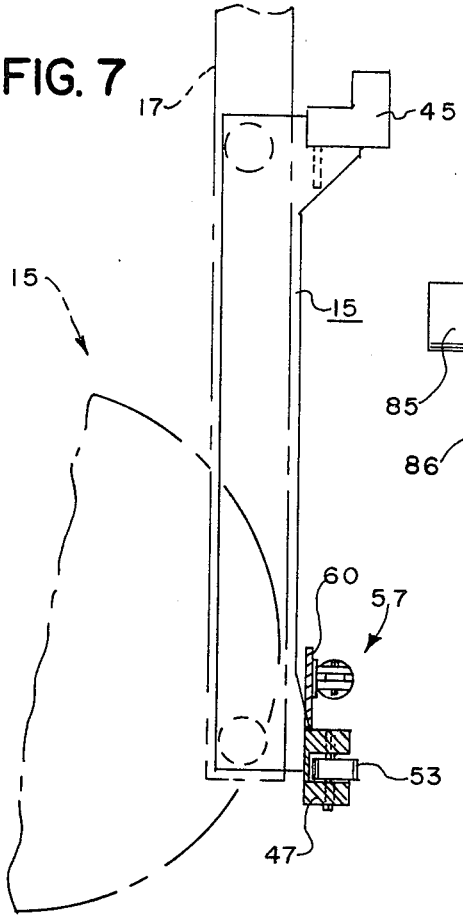
FIG. 7 is a sectional view as taken on line VII—VII of FIG. 6.
Figure 8:
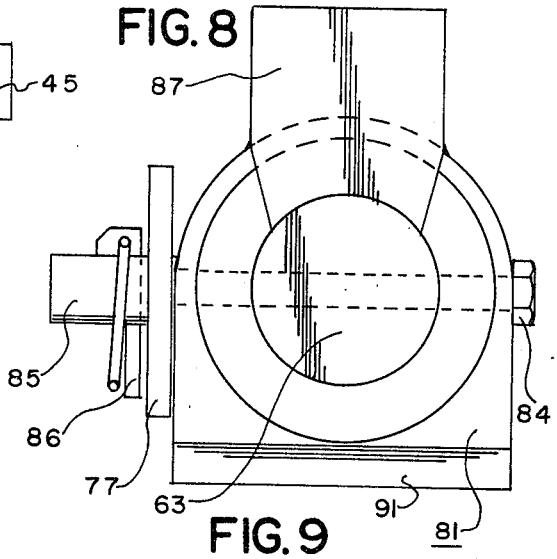
FIG. 8 is a side elevational view of a portion of one fork means of the fork attachment means of the present invention.

The carriage 15 of the fork lift truck 13 includes an upper cross frame member 45 and, preferably, a lower cross member 47 to which the first frame means 21 is attached. For example, the first frame means 21 may include structure for hooking over the upper cross frame means 21 to the carriage 15 to attach the first frame means 21 to the carriage 15 in a hook like manner. More specifically, the first frame means 21 may include one or more rollers 49 attached to the upper cross frame member 35 thereof for hookably engaging the upper cross frame member 45 of the carriage 15 to thereby attach the first frame means 21 to the carriage 15 in a manner as will be apparent to those skilled in the art (see, in general, FIG. 4). The first frame means 21 may also include one or more lower rollers 51 attached to the lower cross frame member 33 for engaging the lower cross frame member 45 of the carriage 15 to support the first frame means 21 on the carriage 15 (see, in general, FIG. 4). Further, the carriage 15 may include one or more rollers 53 attached to the lower cross frame member 47 thereof for engaging the lower cross frame member 33 of the first frame means 21 to aid in the support of the first frame means 21 on the carriage 15 (see, in general, FIG. 4). Hook-like members 55 may be attached to the lower cross frame member 33 of the first frame means 21 to aid in securing the first frame means 21 to the carriage 15 in a manner as will be apparent to those skilled in the art (see, in general, FIG. 4). It should be noted that the rollers 49, 51, 53 will allow the first frame means 21 to slide sidewards on the carriage 15. Piston means 57 may be provided between the carriage 15 and the first frame means 21 to allow the operator of the lift truck 13 to accurately move the first frame means 21 sidewards relative to the carriage 15 (see, in general, FIG. 3). More specifically, the piston means 57 may include a piston cylinder 59 attached to the lower cross frame member 47 of the carriage 15 by way of a plate member 60 (see, in general, FIG. 6) and a piston rod 61 attached to the lower cross frame member 33 of the first frame means 21 by way of a plate member 62 (see, in general, FIG. 3) to cause relative sideward movement between the carriage 15 and the first frame means 21 when the piston means 57 is activated as will be apparent to those skilled in the art.

The second frame means 23 is substantially identical to the first frame means 21 and the above description of the first frame means 21 should be referred to for an understanding of the second frame means 23. It should be noted that the first and second frame means 21, 23 are sidewardly moveable on the carriage 15 in opposite directions independently of one another. More specifically, when viewed head on, the first frame means 21 is slidable from substantially the center of the carriage 15 outward towards the left while the second frame means 23 is slidable substantially from the center of the carriage 15 outwardly to the right (see, in general, FIG. 11).

Figure 12:
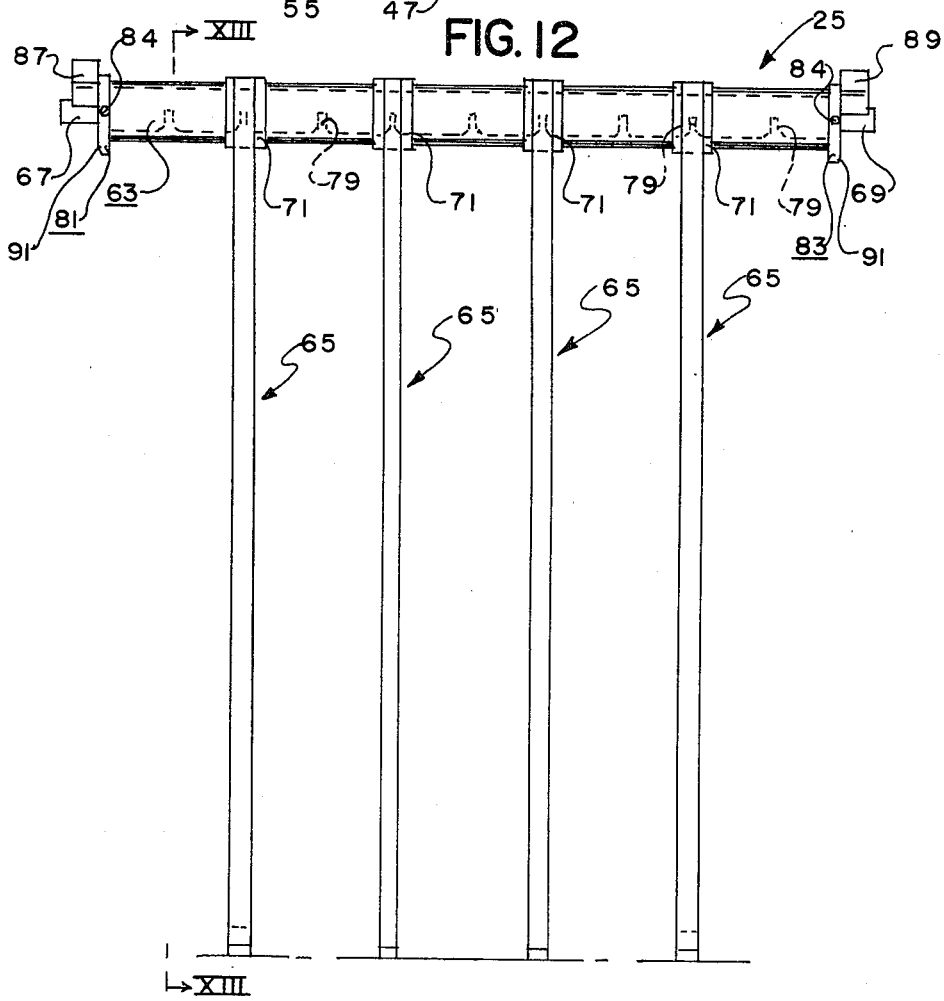
FIG. 12 is a front elevational view of one of the fork means of the fork attachment means of the present invention.
Figure 15:
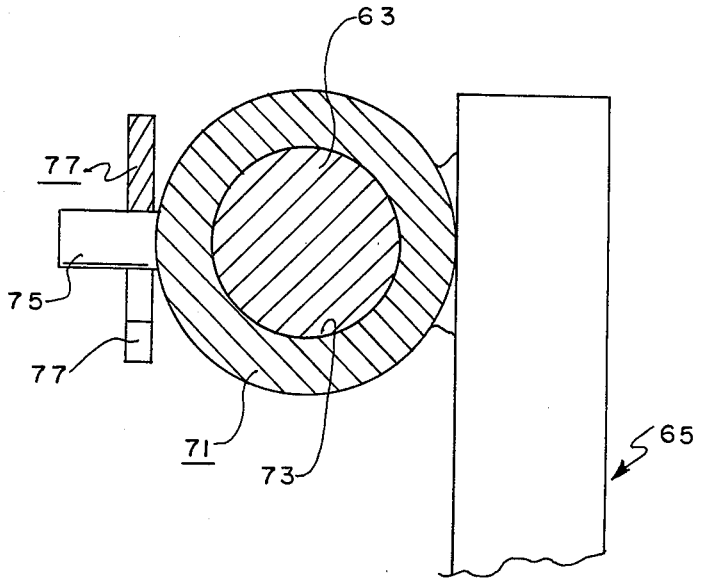
FIG. 15 is a sectional view as taken on line XV—XV of FIG. 14.

The first fork means 23 is for being removably attached to the first frame means 21. The first fork means 25 includes an elongated shaft member 63 and a plurality of fork members 65 attached to the shaft member 63 (see, in general, FIG. 12). The shaft member 63 has a first end 67 for being selectively positioned in the notch 37 in the upper end of the first side frame member 29 of the first frame means 23 and includes a second end 69 for being positioned in the notch 37 in the upper end of the second side frame member 31 of the first frame means 21. The first fork means 25 preferably includes a plurality of bushing members 71 for pivotally and slidably mounting each of the fork members 65 to the shaft member 63. More specifically, each fork member 65 is preferably fixedly attached to a bushing member 71 in any manner apparent to those skilled in the art such as by being welded thereto. Each bushing member 71 has an aperture 73 therethrough for allowing the shaft member 63 to freely extend therethrough to thereby slidably and pivotally attach the fork members 65 to the shaft member 63 (see, in general, FIG. 13). Grease fittings (not shown) may be provided on each bushing member 71 to allow grease to be inserted between the bushing members 71 and the shaft member 63 to allow the bushing members 71 to easily pivot and slide upon the shaft member 63. An outwardly directed peg member 75 is fixedly attached to each bushing member 71. The first fork means 25 preferably includes an elongated fork indexing bar member 77 for being attached to the shaft member 63 and for spacing the bushing members 71, and, therefore, the fork members 65, along the length of the shaft member 63 (see, in general, FIG. 14). The bar member 77 has a plurality of spaced slots 79 therein for receiving the peg members 75 to thereby control the spacing of the bushing members 71 and, therefore, the fork members 65, along the length of the shaft member 63. The first fork means 25 preferably includes a first collar member 81 for being attached to the shaft member 63 adjacent the first end 67 thereof and preferably includes a second collar member 83 for being attached to the shaft member 63 adjacent the second end 69 thereof (see, in general, FIG. 12). The collar members 81, 83 are preferably removably attached to the shaft member 63 by way of bolts 84 or the like. The bar member 77 is preferably removably attached to the first and second collar members 81, 83 and, therefore, the shaft member 63 in any manner apparent to those skilled in the art. For example, outwardly extending protrusions 85 may be welded to each collar member 81, 83 onto which the bar member 77 is inserted. A typical and well known quick release pin member 86 may extend through a transverse aperture in each protrusion 85 to secure the bar member 77 thereon. The first fork means 25 includes at least one alignment member for coacting with one of the notches 37 of the first frame means 21 in a cam-like manner to cause the slots 79 to be substantially vertically aligned when shaft member 63 is attached to the first frame means 21. More specifically, the first fork means 21 preferably includes a first alignment member 87 attached to the first collar member 81 for coacting with the notch 37 in the upper end of the first side frame member 29 and preferably includes a second alignment member 89 attached to the second collar member 83 for coacting with the notch 37 in the upper end of the second side frame member 31. The first and second alignment members 87, 89 coact with the notches 37 to cause the slots 79 in the bar member 77 to be substantially vertically aligned when the first and second ends of the shaft member 63 are positioned in the notches 37 of the side frame members 29, 31 and when the mast 17 is in a substantially vertical position. More specifically, each alignment member 87, 89 is sized so as to substantially fill the area between the first and second leg portions 39, 41 of the upper ends of the first and second frame members 29, 31 to allow the shaft member 63 to be received in the notches 37 in only one way (i.e., with the longitudinal axis of the slots 79 substantially aligned with the longitudinal axis of each side frame member 29, 31). The lower end of each alignment member 87, 89 may be slightly pointed to easily enter the notches 37. The bar member 77 preferably has more slots 79 therein than the first fork means 25 has fork members 65 so that the spacing between the fork members 65 can be varied.

Figure 9:
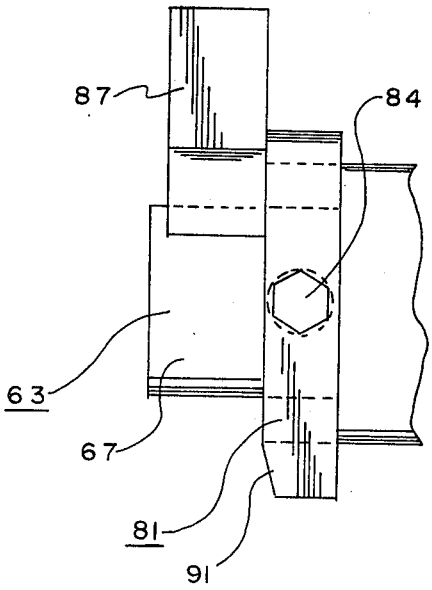
FIG. 9 is a front elevational view of FIG. 8.
Figure 10:
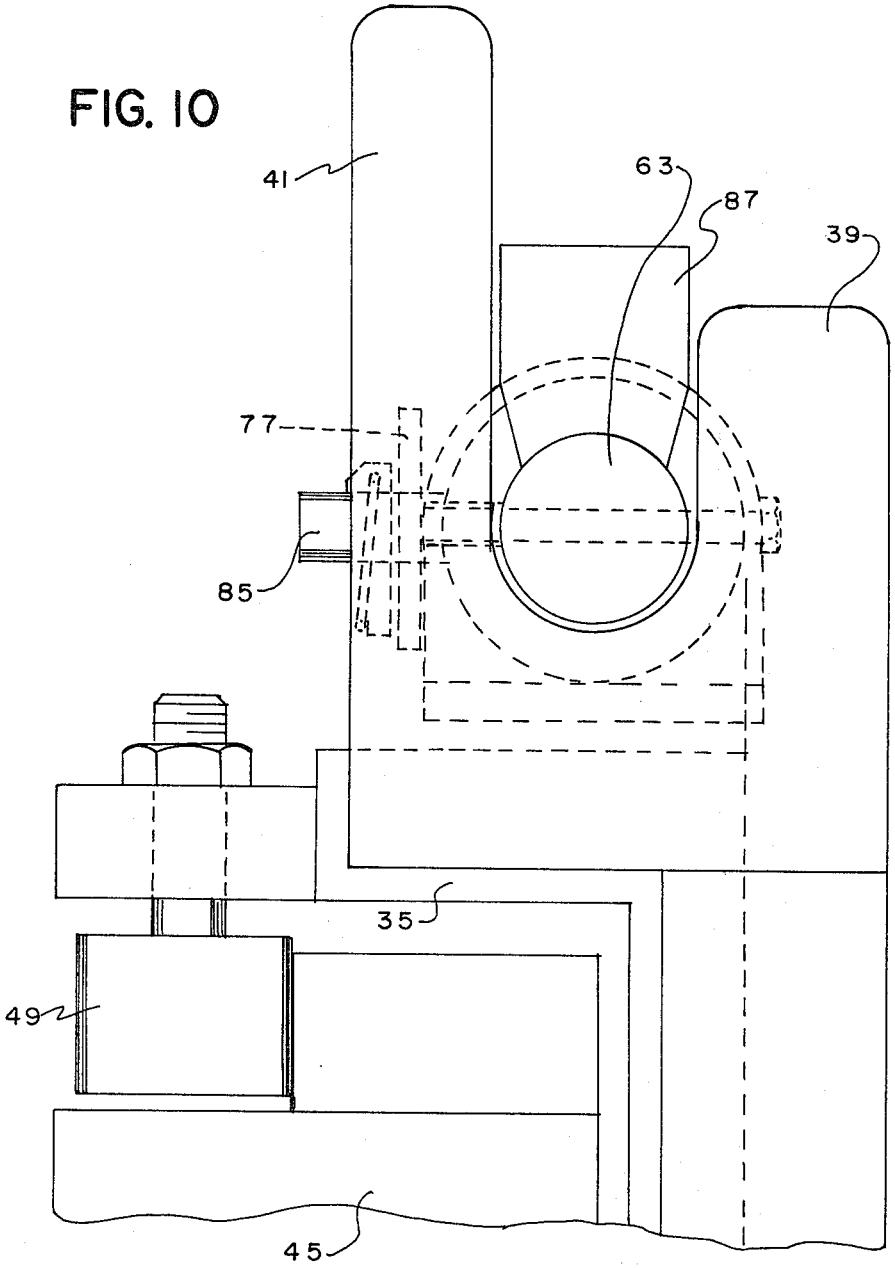
FIG. 10 is a side elevational view of a portion of the fork attachment means of the present invention shown mounted on a portion of the carriage of a fork lift truck.

The lower outer edge of each collar member 81, 83 is preferably inwardly angled to form a cam surface 91 (see, in general, FIG. 9) for coacting with the cam surfaces 43 of the first and second side frame members 29, 31 to aid in the positioning of the shaft member 63 in the notches 37 of the first and second side frame members 29, 31 in a manner which will hereinafter become apparent.

Figure 1:
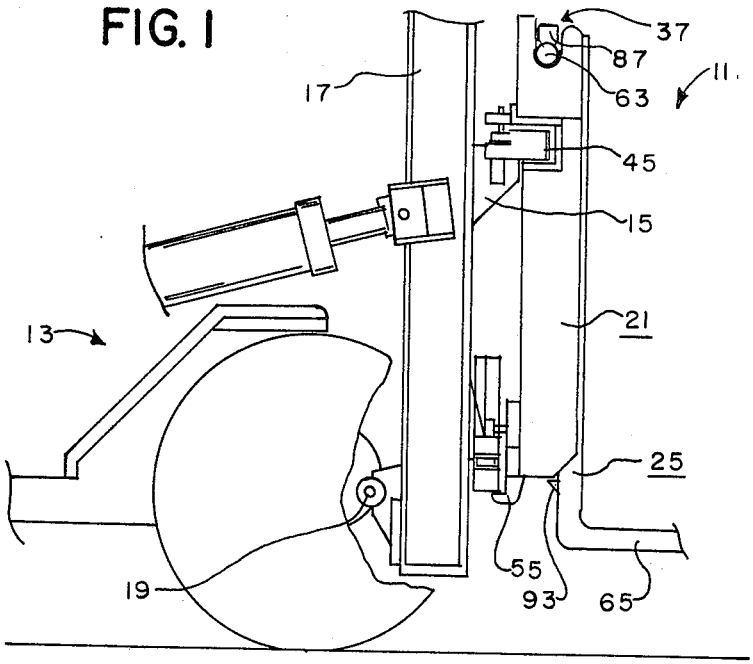
FIG. 1 is a somewhat diagrammatic side elevational view of the fork attachment means of the present invention shown mounted on a fork lift truck with the mast of the fork lift truck vertical.

The first fork means 25 preferably includes at least one hook member 93 fixedly attached to one of the fork members 65 for extending underneath a portion of the first frame means 21 when the carriage 15 is in a substantially vertical position to prevent the shaft member 63 from accidently moving out of the notches 37 of the first and second side frame members 29, 31 (see, in general, FIG. 1). More specifically, at least one and preferably two of the fork members 65 is provided with a hook member 93 for extending underneath a portion of the lower cross frame member 33 of the first frame means 21.

The second fork means 27 is substantially identical to the first fork means 25 and is adapted to be removably attached to the second frame means 23 in much the same manner as heretofore described relative to the first fork means 25 being removably attached to the first frame means 21. The above description of the first fork means 25 should be consulted for an understanding of the second fork means 27.

Figure 2:
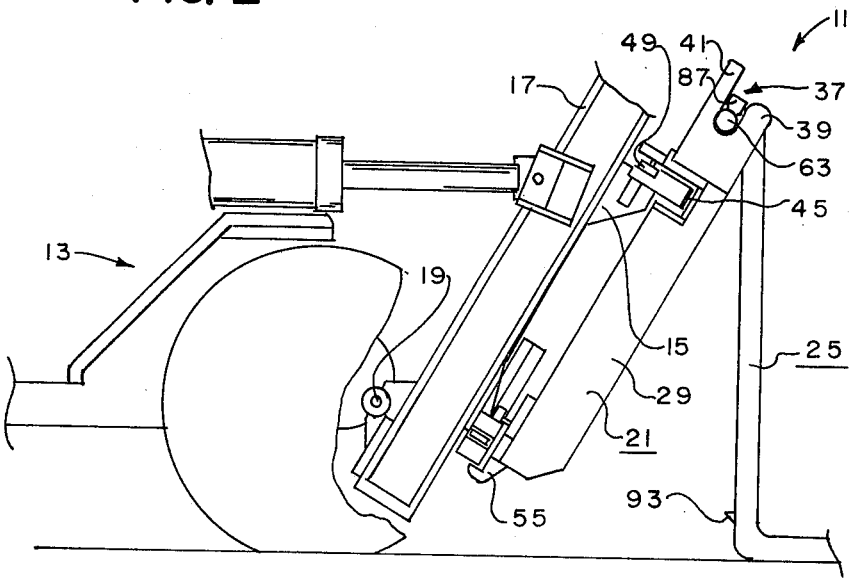
FIG. 2 is similar to FIG. 1 but with the mast of the fork lift truck tilted outwardly.

The use and operation of the fork attachment means 11 of the present invention is quite simple. First, the frame means 21, 23 are attached to the carriage 15 with the rollers 49 engaging a portion of the upper cross frame member 45, with the rollers 51 engaging a portion of the lower cross frame member 47, and with the rollers 53 engaging the lower cross frame member 33 (Note: the carriage 15 may be regarded as an inner carriage and the frame means 21, 23 may be regarded as left and right outer side shift carriages, respectively). The lift truck 13 is then moved adjacent fork means 25, 27 resting on a supporting surface with the mast 17 pivoted in an extreme forward direction substantially as shown in FIG. 2 to allow the forward leg portion 39 of the side frame members 29, 31 to pass underneath the outer ends of the shaft members 63. The mast 17 can then be straightened and the carriage 15 raised upwardly on the mast 17 causing the shaft member 63 to enter the notches 37. The cam surfaces 43, 91 will coact with one another to substantially centrally position the first and second fork means 25, 27 between the side frame members 29, 31 of the first and second frame means 21, 23 respectively.

Figure 16:
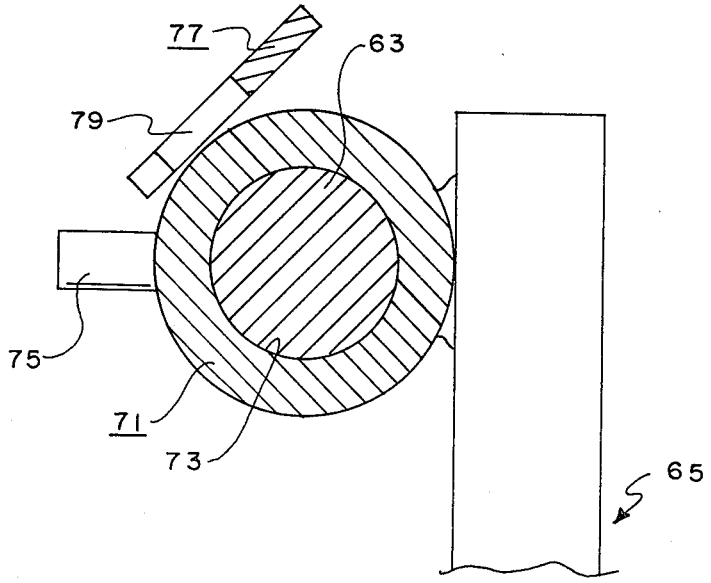
FIG. 16 is a sectional view similar to FIG. 15 but with the fork attachment means shown as if in the position shown in FIG. 2.

To adjust spacing between the fork member 65 of either fork means 25, 27, the carriage 15 is raised vertically on the mast 17 so that the lower portions of the fork members 65 are above the ground and the mast 17 is pivoted forward about the pivot 19. Gravity will then cause the fork members 65 and bushing members 71 to rotate about the shaft member 13 whereupon the peg members 75 will become free of the slots 79 as shown in FIG. 16. The fork members 65 and bushing members 71 can then be manually slid along the shaft member 63 to align the peg members 75 with different slots 79. The mast 17 is then pivoted back to a substantially vertical position whereupon the fork members 65 and bushing members 71 will again pivot about the shaft member 63 to cause the peg member 75 to enter the slots 79 whereby the spacing between the fork members 65 is again fixed by way of the bar members 77. Rather than adjusting the spacing between the fork members 65 as above described, it should be noted that because of the ease of removing and replacing the fork means 25, 27 of the fork attachment means 11, it may be desired to have various different fork means 25, 27 with the spacing and/or number of fork members 65 specifically adapted to lift various types of material (e.g., "bricks" and/or "blocks") and any time it is desired to lift material requiring a different spacing and/or number of fork members 65, the fork means 25, 27 on the fork truck 13 may be removed simply by tilting the mast 17 to an extreme forward position, and lowering the carriage 15 until the fork members 65 rest upon the ground to allow the first leg portion 39 of the upper ends of the side frame members 29, 31 to clear the shaft member 63 thereby allowing the truck 13 to be backed away from the fork means 25, 27. Different fork means 25, 27 can then be installed on the frame means 21, 23 in the manner heretofore described.

As thus constructed and used, the present invention allows a fork lift truck to handle a plurality of side-by-side stacks of bricks and/or blocks, etc., at one time; allows a plurality of fork assemblies to be mounted on a single fork lift truck; and allows such fork assemblies to be easily and quickly replaced and/or adjusted; etc.

Although the invention has been described and illustrated with respect to a preferred embodiment thereof, it is not to be so limited since changes and modifications may be made therein which are within the full intended scope of the invention.

I claim:

1. A fork attachment means for a fork lift truck having a carriage, said fork attachment means comprising:

(a) frame means for being attached to the carriage of the fork lift truck, said frame means including first and second side frame members, each of said side frame members having an upper end and having a notch in said upper end thereof; and (b) fork means for being removably attached to said frame means, said fork means including an elongated shaft member and including a plurality of fork members attached to said shaft member, said shaft member having a first end for being selectively positioned in said notch of said first side frame member and having a second end for being selectively positioned in said notch of said second side frame member to attach said fork means to said frame means, said fork means including alignment means for coacting with said notch in said upper end of one of said side frame members and for properly aligning said shaft member with respect to said frame means, said fork means including a plurality of bushing members for pivotally and slidably mounting each of said fork members to said shaft member, an outwardly directed peg member being fixedly attached to each bushing member, and said fork means including an elongated fork indexing bar member for being attached to said shaft member and for spacing said bushing members along said shaft member, said bar member having a plurality of spaced slots for receiving said peg members.

2. A fork attachment means for a fork lift truck having a carriage, said fork attachment means comprising:

(a) frame means for being attached to the carriage of the fork lift truck, said frame means including first and second side frame members, each of said side frame members having an upper end and having a notch in said upper end thereof; and (b) fork means for being removably attached to said frame means, said fork means including an elongated shaft member and including a plurality of fork members attached to said shaft member, said shaft member having a first end for being selectively positioned in said notch of said first side frame member and having a second end for being selectively positioned in said notch of said second side frame member to attach said fork means to said frame means, said fork means including a plurality of bushing members for pivotally and slidably mounting each of said fork member to said shaft member, an outwardly directed peg member being fixedly attached to each bushing member, said fork means including an elongated fork indexing bar member for being attached to said shaft member and for spacing said bushing members along said shaft member, said bar member having a plurality of spaced slots for receiving said peg members, said fork means including a first collar member for being attached to said shaft member adjacent one end thereof and a second collar member for being attached to said shaft member adjacent the other end thereof, said bar member being attached to said first and second collar members; said fork means including a first alignment member attached to said first collar member for coacting with said notch in said upper end of said first side frame member of said frame means and for causing said slots of said bar member to be substantially vertically aligned when said first and second ends of said shaft member are positioned in said notches of said side frame members of said frame means.

3. The fork attachment means of claim 2 in which said upper ends of each of said side frame members of said frame means have an angled cam surface and in which the lower edge of each of said collar members have an angled cam surface for coacting with the cam surface of said side frame members to aid in the positioning of said shaft member in said notches of said side frame members.

4. The fork attachment means of claim 2 in which said bar member has more of said slots therein than the number of said bushing members for allowing the spacing between said bushing members to be varied.

5. The fork attachment means of claim 4 in which said fork means includes a hook member fixedly attached to one of said fork members for extending underneath a portion of said frame means when the carriage of the fork lift truck is in a substantially vertical position to prevent said shaft member from accidently moving out of said notches of said side frame members.

6. The fork attachment means of claim 5 in which is included piston means for causing said frame means to move sidewards relative to the carriage of the fork lift truck, said piston means having a first end for being attached to the carriage of the fork lift truck and having a second end for being attached to said frame means.

7. A fork attachment means for a fork lift truck having a carriage, said fork attachment means comprising:

(a) frame means for being attached to the carriage of the fork lift truck, said frame means including first and second side frame members, each of said side frame members having an upper end and having a notch in said upper end thereof; and (b) fork means for being removably attached to said frame means, said fork means including an elongated shaft member and including a plurality of fork members pivotally and slidably attached to said shaft member, an outwardly directed peg member being fixedly attached to each fork member, said shaft member having a first end for being selectively positioned in said notch of said first side frame member and having a second end for being selectively positioned in said notch of said second side frame member to attach said fork means to said frame means, said fork means including a fork indexing member for being attached to said shaft member and for spacing said fork members along said shaft member, said fork indexing member having a plurality of spaced slots for receiving said peg members, said fork means including alignment means attached to said shaft member for coacting with said notch in said upper end of one of said side frame members and for causing said slots in said fork indexing member to be substantially vertically aligned when said first and second ends of said shaft member are positioned in said notches of said side frame members of said frame means.

* * * * *